United States Patent [19]

Zaghloul et al.

[11] Patent Number: 5,005,019

[45] Date of Patent: Apr. 2, 1991

[54] ELECTROMAGNETICALLY COUPLED PRINTED-CIRCUIT ANTENNAS HAVING PATCHES OR SLOTS CAPACITIVELY COUPLED TO FEEDLINES

[75] Inventors: Amir I. Zaghloul, Bethesda; Robert M. Sorbello, Potomac, both of Md.

[73] Assignee: Communications Satellite Corporation, Washington, D.C.

[21] Appl. No.: 930,187

[22] Filed: Nov. 13, 1986

[51] Int. Cl.[5] ..... H01Q 1/00

[52] U.S. Cl. ..... 343/700 MS

[58] Field of Search ..... 343/700 MS

[56] References Cited

U.S. PATENT DOCUMENTS 4,477,813 10/1984 Weiss ..... 343/700 MS

FOREIGN PATENT DOCUMENTS 55-93305 7/1980 Japan .
57-87206 5/1982 Japan .
59-207703 11/1984 Japan .
2046530 11/1980 United Kingdom .

OTHER PUBLICATIONS

Electronics Letters, Mar. 4, 1982, vol. 18, No. 5, "Study on Ellipticity Properties of Single-Feed-Type Circularly Polarized Microstrip Antennas", Haneishi et al.
Microwave Journal, Sep., 1977, pp. 1.-1 thru 1.-4, "Microstrip Antenna Array for 12 GHz TV", Collier.
"Microstrip Antennas", I. J. Bahl et al., pp. 238-239.
"Antenna for Direct Reception of Broadcast from Satellites", C. H. Hilyard, 1983 IEE Conference Report Series.
"Flat Antenna", Haneishi, vol. 33, No. 11, Institute of Television Engineers of Japan.
"An Improved Theory for Microstrip Antennas and Application", Richards, IEEE AP-29, No. 1, Jan., 1981.
"Analysis and Optimized Design of Single Feed Circularly Polarized Microstrip Antennas", P. C. Sharma et al., IEEE Transaction on Antennas and Propagation, vol. AP-31, No. 6, Nov., 1983.
"Microstrip Antenna Theory and Design", IEE Conference Report Series.

*Primary Examiner*—William L. Sikes
*Assistant Examiner*—Robert E. Wise
*Attorney, Agent, or Firm*—Sughrue, Mion, Zinn, Macpeak & Seas

[57] ABSTRACT

A printed-circuit antenna array having broadband linear polarization, and circular polarization with high polarization purity, feedlines of the array being capacitively coupled to feeding elements at a single feedpoint or at multiple feedpoints, the feeding elements in turn being electromagnetically coupled to corresponding radiating elements. The radiating elements may be patches, disposed on a dielectric board which is contactlessly coupled to another board containing the feeding elements, in accordance with a first embodiment of the invention. Alternatively, the radiating elements may be slots, formed by an absence of material in ground planes which are formed on the same dielectric board as the feeding elements. Still further, both radiating patches and radiating slots may be used. The exclusively contactless coupling enables simple, inexpensive multilayer manufacture.

29 Claims, 15 Drawing Sheets

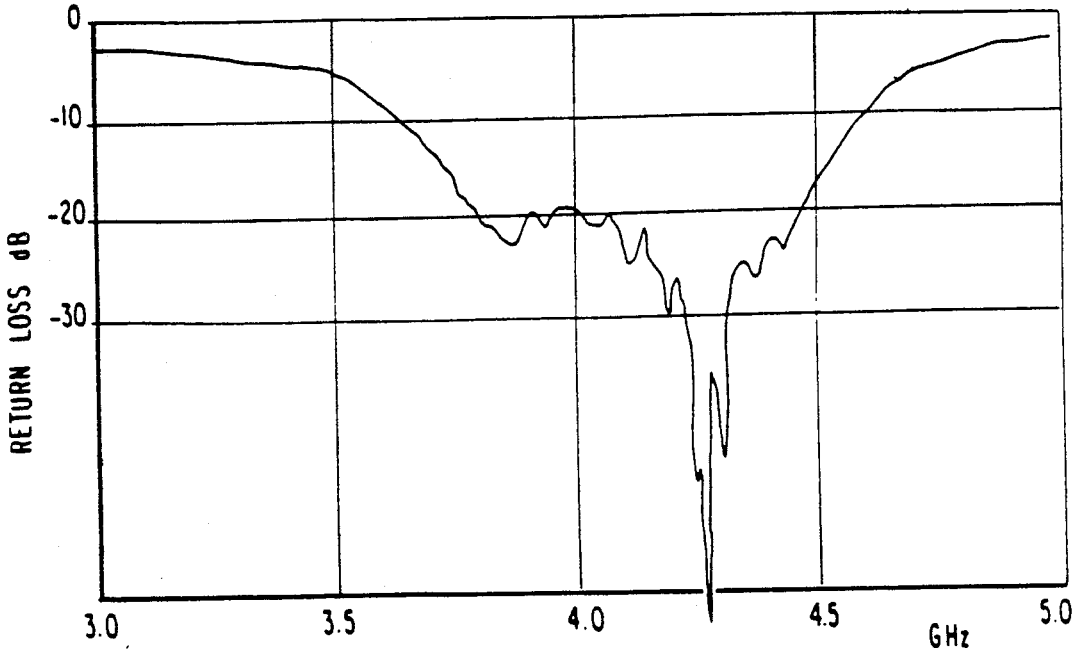
FIG. 2 - RETURN LOSS OF OPTIMIZED LINEARLY POLARIZED CF-EMCP ELEMENT
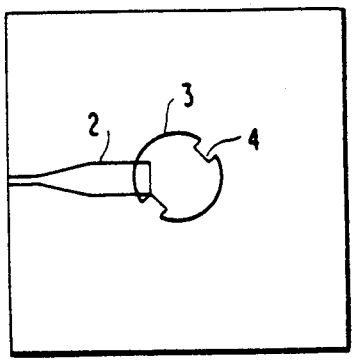
FIG. 3a - CONFIGURATION OF CIRCULARLY POLARIZED CF-EMCP ELEMENT WITH NEGATIVE SEGMENTS (NOTCHES)
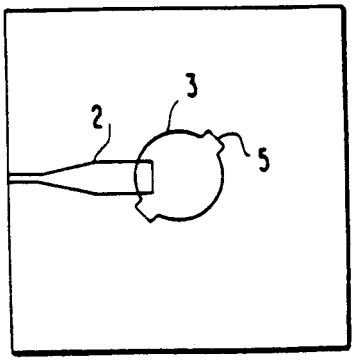
FIG. 3b - CONFIGURATION OF CIRCULARLY POLARIZED CF-EMCP ELEMENT WITH POSITIVE SEGMENTS (TABS)

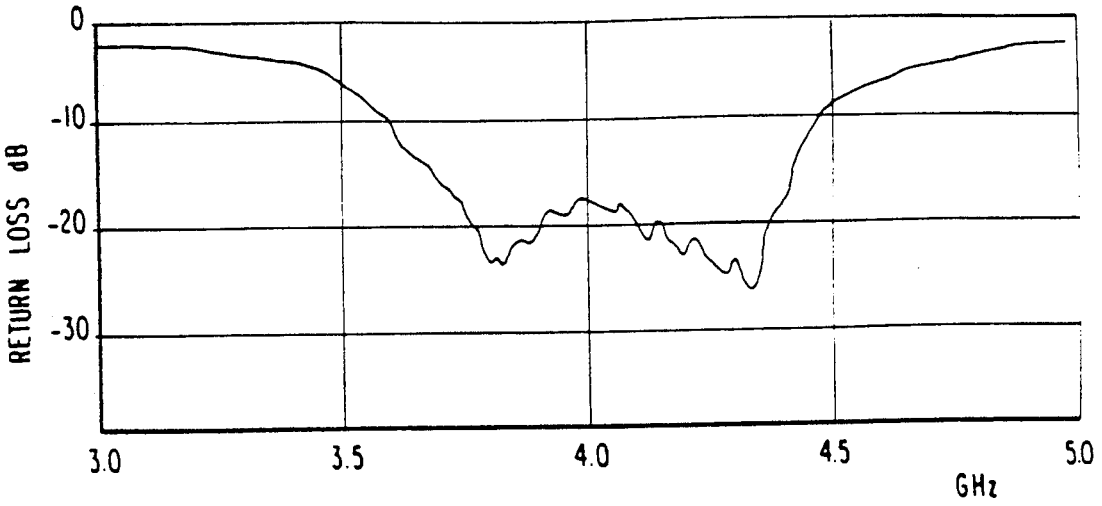
FIG. 4 - RETURN LOSS OF OPTIMIZED CIRCULARLY POLARIZED CF-EMCP ELEMENT
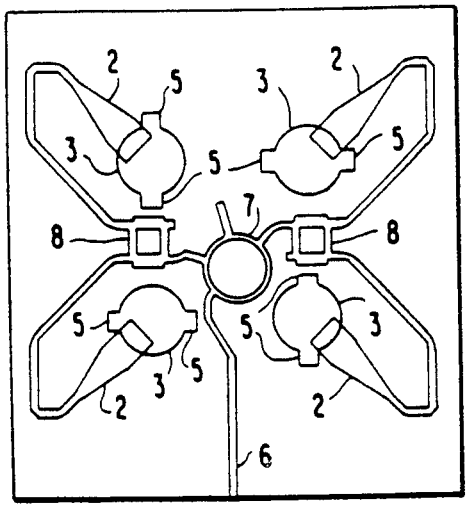
FIG. 5 - CONFIGURATION FOR WIDE-BAND 4-ELEMENT CIRCULARLY POLARIZED CF-EMCP ARRAY

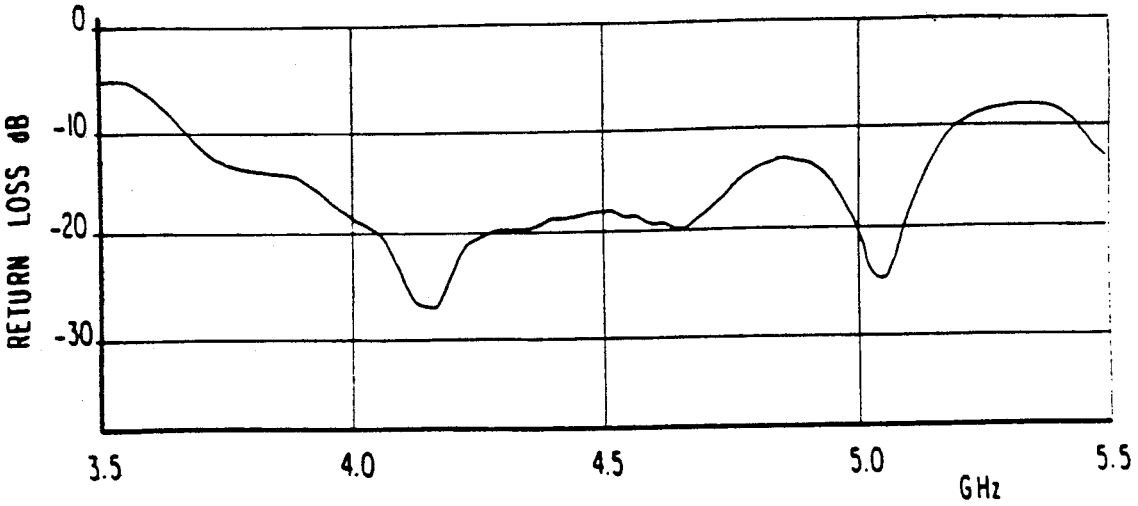
FIG.6 _RETURN LOSS OF 4-ELEMENT CIRCULARLY POLARIZED CF-EMCP
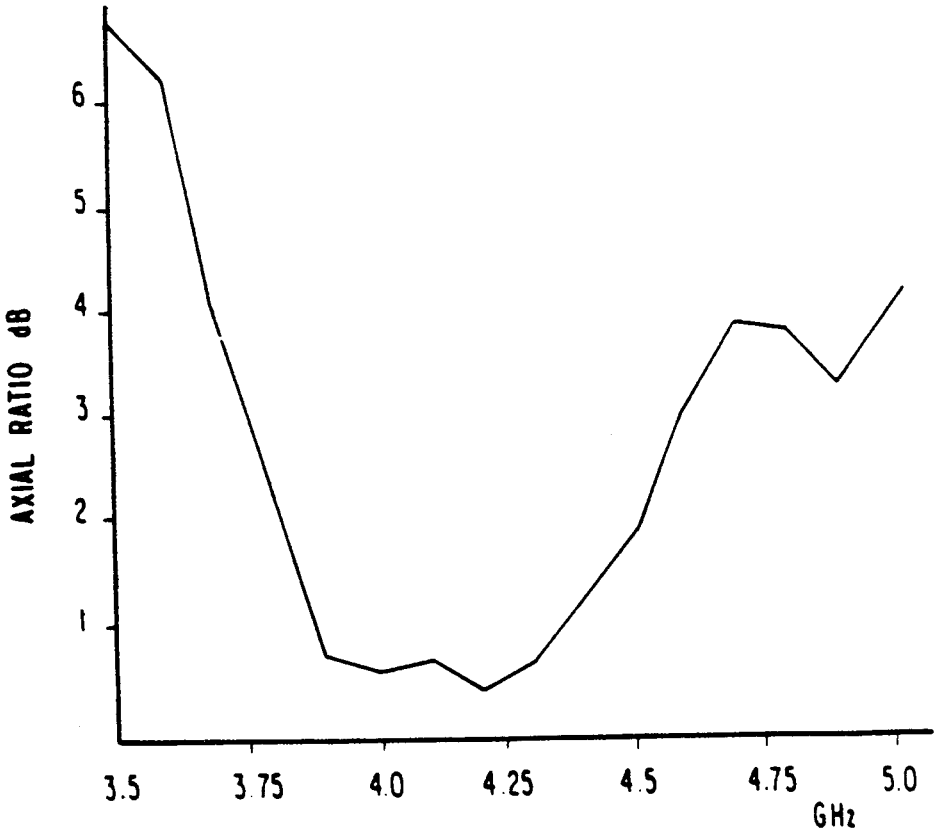
FIG.7 _AXIAL RATIO OF 4-ELEMENT ARRAY

POWER DIVIDING NETWORK

RADIATING SLOTS

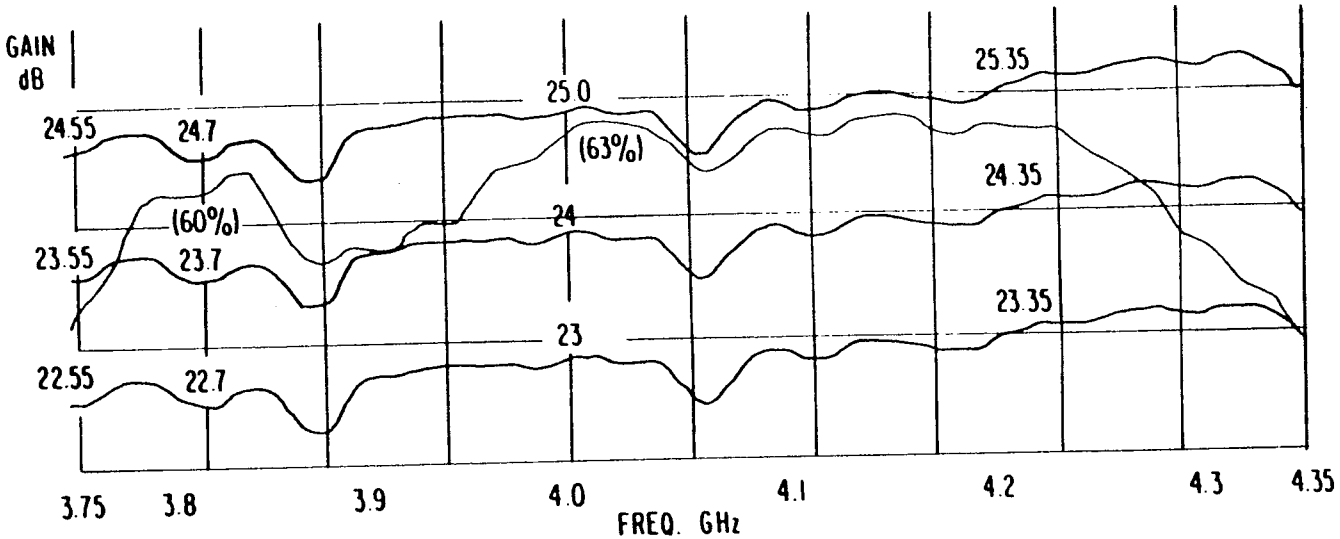
FIG.19
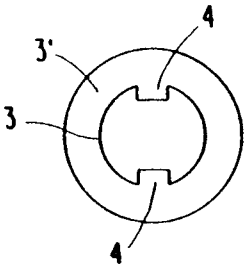
FIG.21c
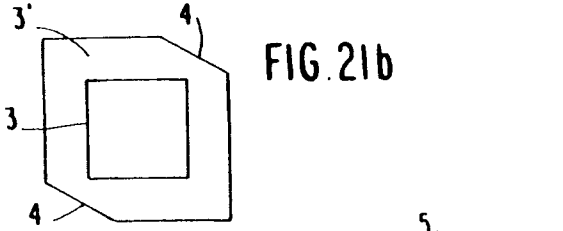
FIG.21b
FIG.21a
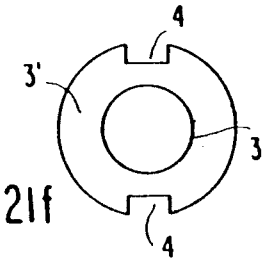
FIG.21f
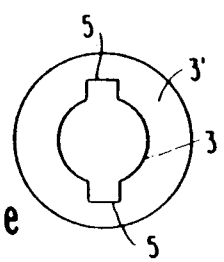
FIG.21e
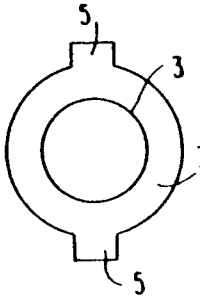
FIG.21d

ELECTROMAGNETICALLY COUPLED PRINTED-CIRCUIT ANTENNAS HAVING PATCHES OR SLOTS CAPACITIVELY COUPLED TO FEEDLINES

BACKGROUND OF THE INVENTION

The present invention relates to a printed-circuit antenna element which is capacitively coupled to a feedline and which produces linear or circular polarization over a wide frequency band. The printed-circuit element is in the form of a conducting patch printed on a dielectric board; if the element is surrounded by a ground plane printed on the same board, the element forms a slot. The printed-circuit element may be directly radiating or electromagnetically coupled to a radiating element, thus forming electromagnetically coupled patches (EMCP) or slots (EMCS). A plurality of such antennas may be combined to make an antenna array.

Printed-circuit antennas have been used for years as compact radiators. However, they have suffered from a number of deficiencies. For example, they are generally efficient radiators of electromagnetic radiation. However, they typically operate over a narrow bandwidth. Also, complicated techniques for connecting them to the feeding circuit have been required to achieve linear and circular polarization, so that low-cost fabrication of arrays of these elements has been difficult to realize.

Some of the above-mentioned problems have been solved. U.S. Pat. No. 3,803,623 discloses a means for making printed-circuit antennas more efficient radiators of electromagnetic radiation. U.S. Pat. No. 3,987,455 discloses a multiple-element printed-circuit antenna array having a broad operational bandwidth. U.S. Pat. No. 4,067,016 discloses a circularly polarized printed-circuit antenna.

The antennas described in the above-mentioned patents still suffer from several deficiencies. They all treat feeding patches directly connected to a feedline.

U.S. Pat. Nos. 4,125,837, 4,125,838, 4,125,839, and 4,316,194 show printed-circuit antennas in which two feedpoints are employed to achieve circular polarization. Each element of the array has a discontinuity, so that the element has an irregular shape. Consequently, circular polarization at a low axial ratio is achieved. Each element is individually directly coupled via a coaxial feedline.

While the patents mentioned so far have solved a number of problems inherent in printed-circuit antenna technology, other difficulties have been encountered. For example, while circular polarization has been achieved, two feedpoints are required, and the antenna elements must be directly connected to a feedline. U.S. Pat. No. 4,477,813 discloses a printed-circuit antenna system with a nonconductively coupled feedline. However, circular polarization is not achieved.

Copending U.S. application Ser. No. 623,877, now U.S. Pat. No. 4,866,451 filed June 25, 1984 and commonly assigned with the present application, discloses a broadband circular polarization technique for a printed-circuit array antenna. While the invention disclosed in this copending application achieves broadband circular polarization. the use of capacitive coupling between the feedline and feeding patch is not disclosed.

With the advent of certain technologies, e.g. microwave integrated circuits (MIC,) monolithic microwave integrated circuits (MMIC,) and direct broadcast satellites (DBS,) a need for inexpensive, easily-fabricated antennas operating over a wide bandwidth has arisen. This need also exists for antenna designs capable of operating in different frequency bands. While all of the patents discussed have solved some of the technical problems individually, none has yet provided a printed-circuit antenna having all of the features necessary for practical applications in certain technologies.

SUMMARY OF THE INVENTION

Accordingly, it is one object of the present invention to provide a printed-circuit antenna which is capable of operating over a wide bandwidth, in either linear or circular polarization mode, yet which is simple and inexpensive to manufacture.

It is another object of this invention to provide a printed-circuit antenna and its feed network made of multiple layers of printed boards which do not electrically contact each other directly, wherein electromagnetic coupling between the boards is provided.

It is another object of the invention to provide a printed-circuit antenna having a plurality of radiating elements, each radiating element being a radiating patch or slot which is electromagnetically coupled to a feeding patch or slot which is capacitively coupled at a single feedpoint, or at multiple feedpoints, to a feedline.

It is another object of the invention to provide a printed-circuit antenna having a plurality of direct radiating patches or slots which are capacitively coupled at a single point, or at multiple feedpoints, to a feedline.

It is yet another object of the invention to provide a printed-circuit antenna having circularly polarized elements, and having a low axial ratio.

Still another object of the invention is to provide a printed-circuit antenna having linearly polarized elements, and having a high axial ratio.

To achieve these and other objects, two embodiments of the present invention are disclosed. In a first embodiment, there are provided a plurality of radiating and feeding patches, or alternatively a plurality of direct radiating patches, each having perturbation segments, the feeding patches being electromagnetically coupled to the radiating patches, the feedline being capacitively coupled to the feeding patch. (To achieve linear polarization, the perturbation segments are not required.)

According to another embodiment of the invention, a feeding patch and a ground plane are printed on the same dielectric board. An absence of metal in the ground plane results in the formation of a radiating slot. As a result, whereas a radiating patch is employed in the first embodiment, employment of a radiating patch in the second embodiment is optional, as the radiating slot obviates the need for the radiating patch. The radiating patch may be left out of the second embodiment, so that a more compact overall structure may be achieved.

In accordance with the second embodiment, there is provided a feeding patch on the same dielectric board as the ground plane, wherein the feeding patch may be on the same side or the opposite side as the ground plane. By combining a number of antenna elements having this structure, there may be provided a plurality of feeding patches and radiating slots, or alternatively a plurality of direct radiating slots, optionally having perturbation segments. The feeding patches form the inner contour of the radiating slots, and the feedline in turn is capacitively coupled to the feeding patch or alternatively to the ground plane wherein the radiating slot is formed, thereby accomplishing capacitive coupling to the direct radiating slots. As with the first embodiment, perturbation segments are not required to achieve linear polarization.

The feed network also can comprise active circuit components implemented using MIC or MMIC techniques, such as amplifiers and phase shifters to control the power distribution, the sidelobe levels, and the beam direction of the antenna.

The design described in this application and demonstrated at C-band can be scaled to operate in any frequency band, such as L-band, S-band, X-band, $K_u$-band, or $K_a$-band.

BRIEF DESCRIPTION OF THE DRAWINGS

The invention will be described below with reference to the accompanying drawings, in which.

Figure 1A:
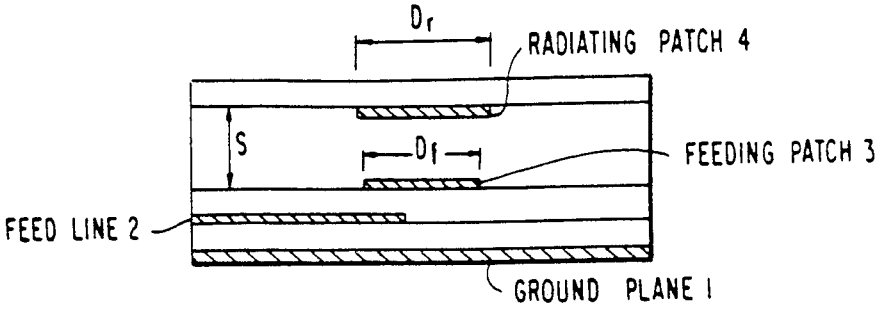
FIG. 1*a* shows a cross-sectional view of a capacitively fed electromagnetically coupled linearly-polarized patch antenna element for a microstrip feedline in accordance with a first embodiment of the invention.
Figure 1B:
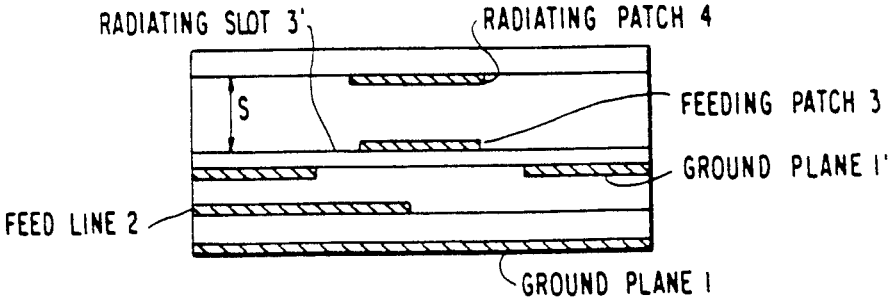
FIG. 1*b* shows a cross-sectional view of a capacitively fed electromagnetically coupled linearly-polarized patch antenna element for a stripline feedline, a radiating slot also being shown which is employed in accordance with a second embodiment of the invention.

FIH. 1*d* shows a top view of the patch antenna element of FIG. 1*b;*

FIG. 2 is a graph of the return loss of the optimized linearly polarized capacitively fed electromagnetically coupled patch element of FIG. 1*a;*

FIGS. 3*a* and 3*b* are schematic diagrams showing a configuration of a circularly polarized capacitively fed electromagnetically coupled patch element, both layers of patches containing perturbation segments, wherein coupling to the feedline occurs at a single point;

FIG. 4 is a graph of the return loss of the element shown in FIG. 3*b;*

Figure 8:
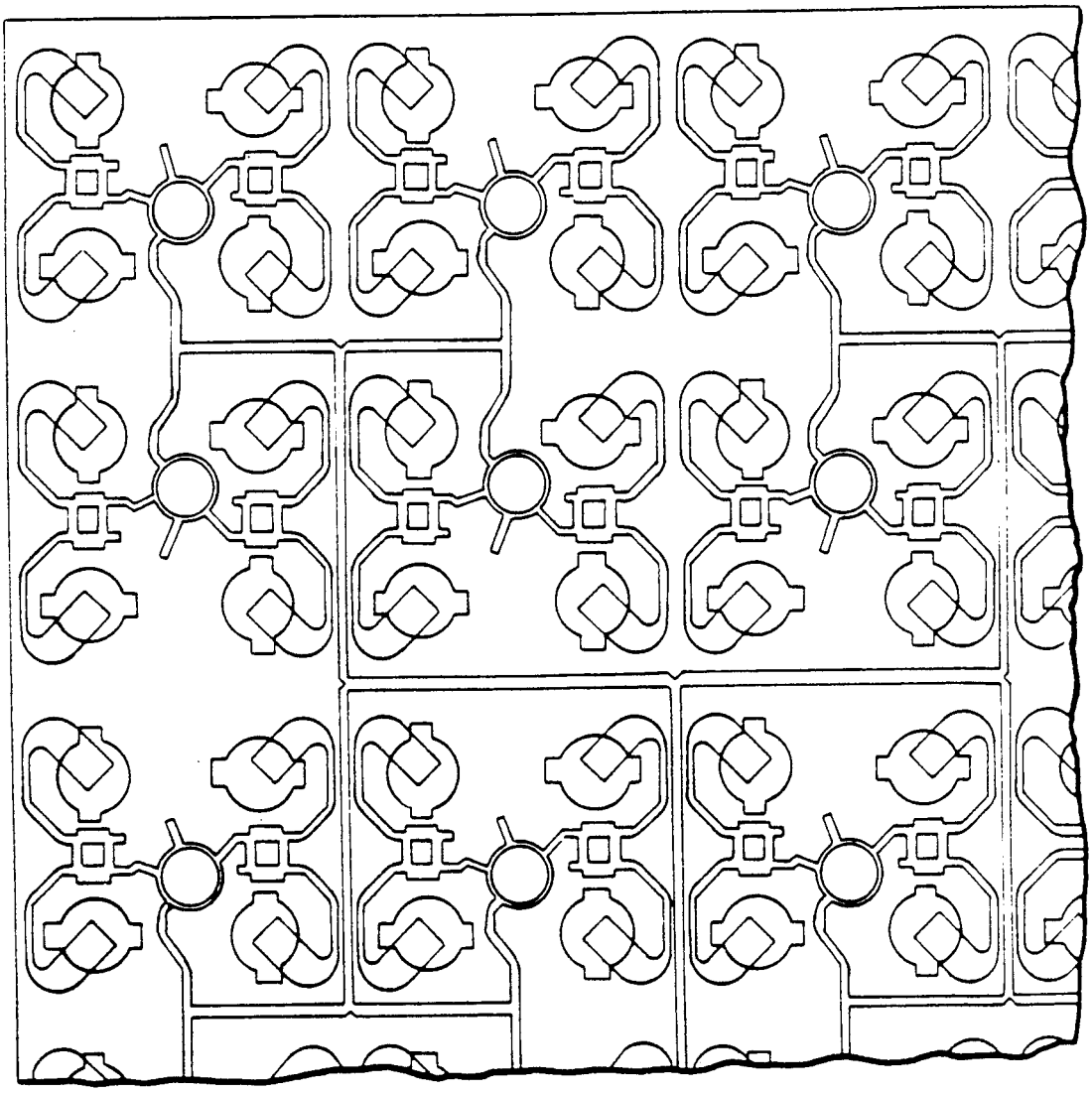
Figure 9A:
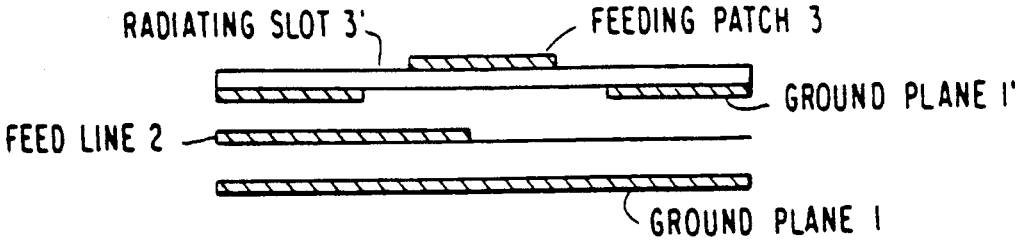
Figure 9B:
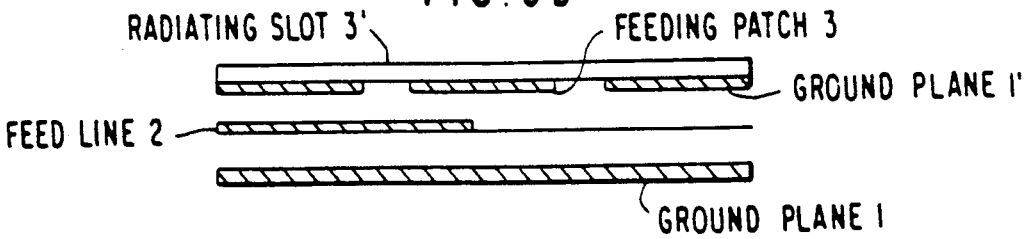
Figure 10A:
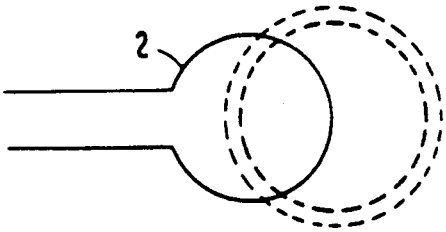
Figure 10B:
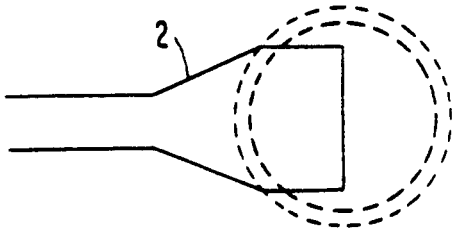
Figure 10C:
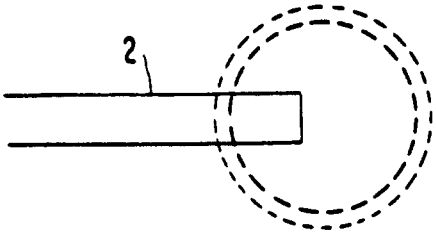

FIG. 5 is a plan view of a four-element microstrip antenna array having a wide bandwidth and circularly polarized elements;

FIG. 6 is a graph showing the return loss of the array shown in FIG. 5;

FIG. 7 is a graph showing the on-axis axial ratio of the array shown in FIG. 5:

FIG. 8 is a plan view of a microstrip antenna array in which a plurality of subarrays configured in a manner similar to the configuration shown in FIG. 5 are used;

FIGS. 9*a* and 9*b* show additional cross-sectional views of a stripline-fed antenna element in accordance with a second embodiment of the invention, this element being a direct radiating slot element;

FIGS. 10*a*–10*c* show several different feeding configurations for the element shown in FIGS. 1*b*, 9*a*, and 9*b:*

FIGS. 11*a*–11*f* show different possible shapes of the slot and slot/patch combinations shown in FIGS. 1*b*, 9*a*, and 9*b;*

Figure 12:
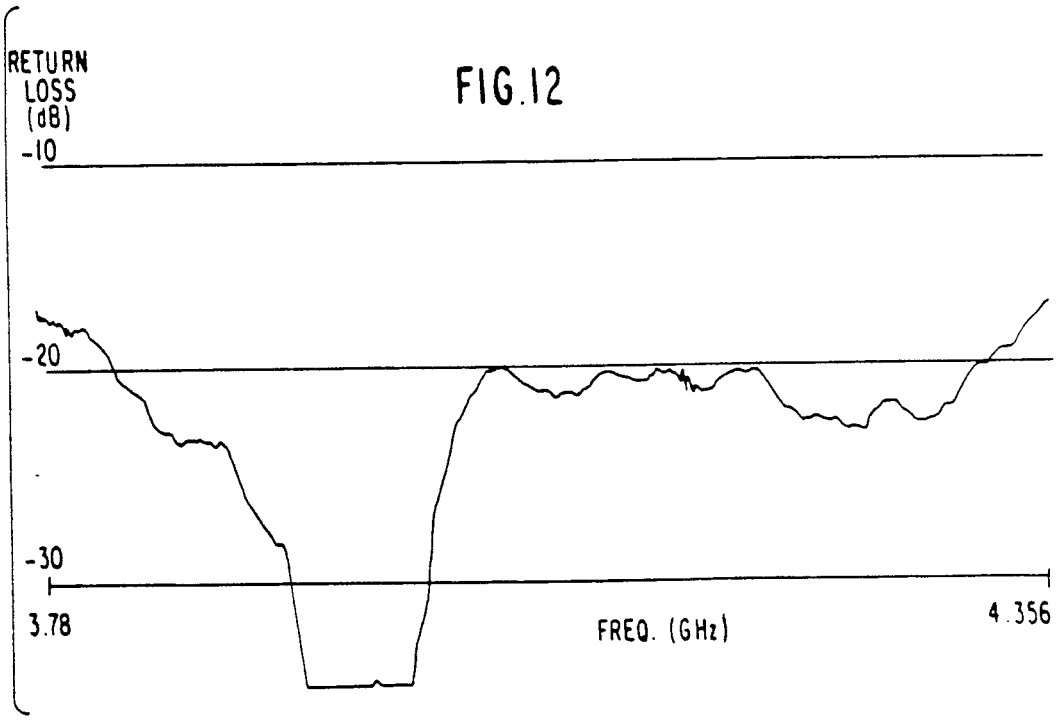

FIG. 12 is a graph of the return loss for a circularly-shaped slot element and radiating patch corresponding to the element shown in FIG. 1*b:*

Figure 11A:
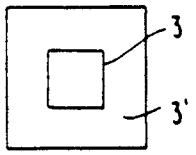
Figure 11B:
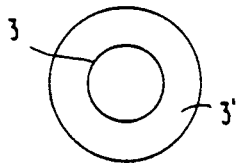
Figure 13:
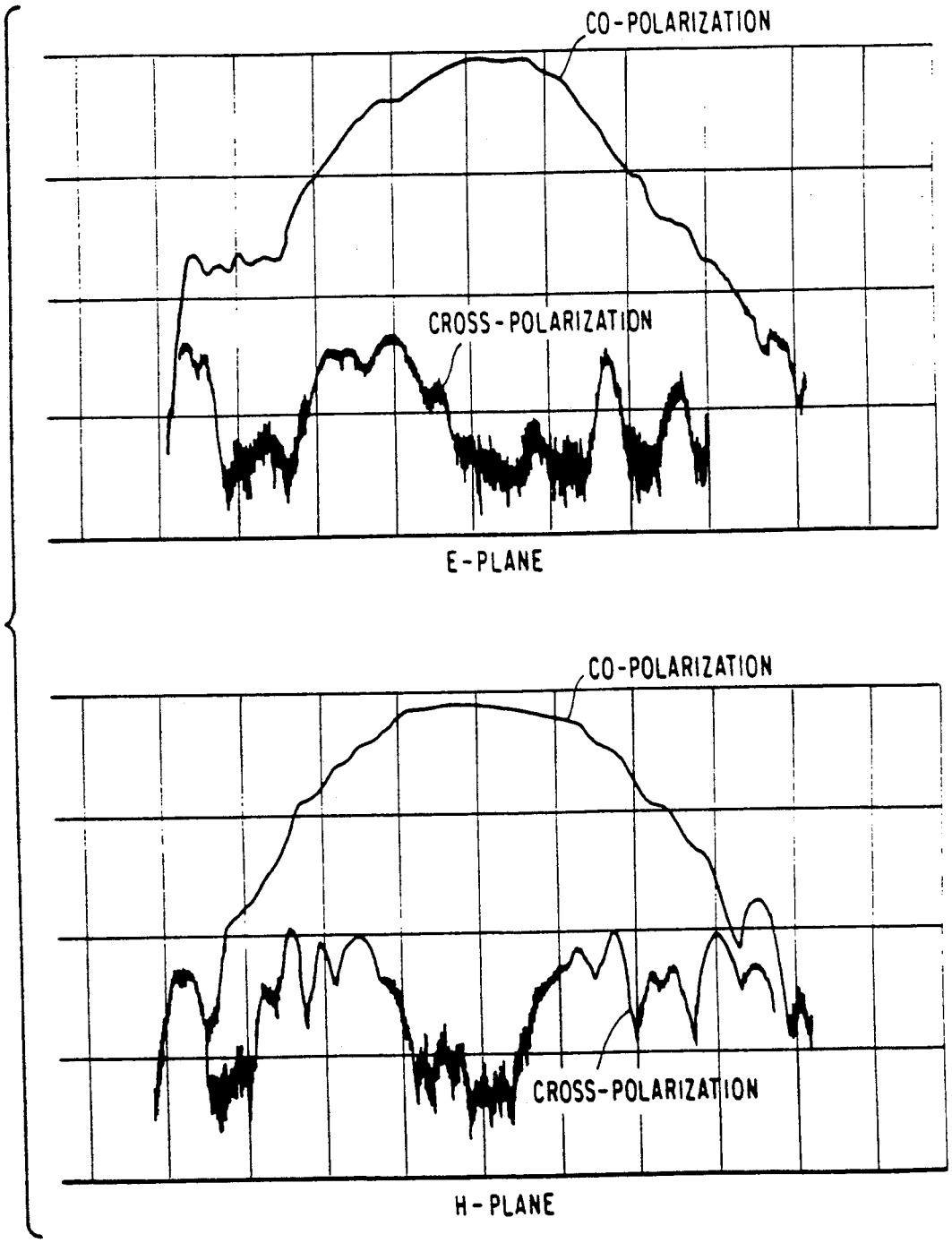
Figure 14:
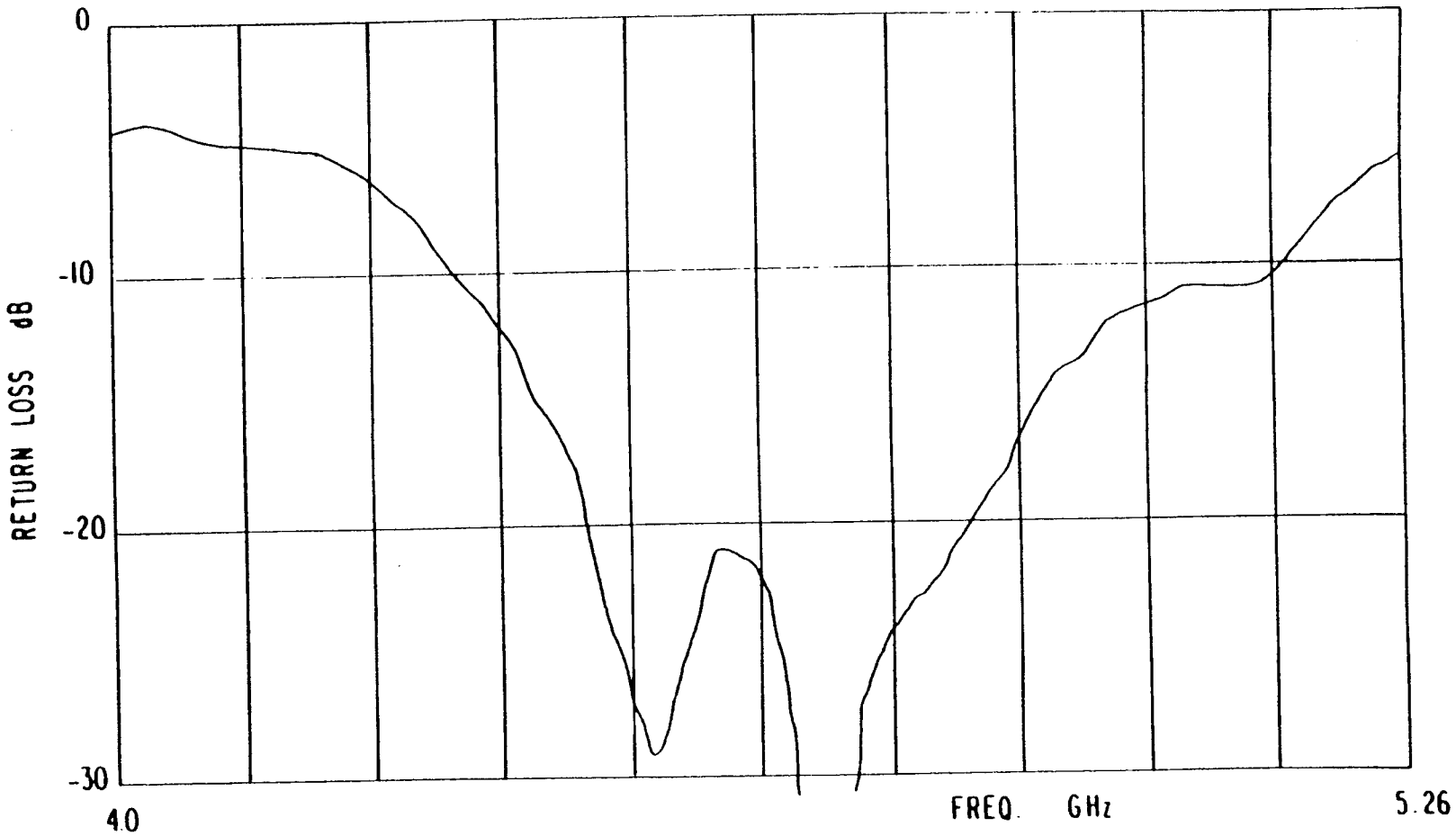

FIG. 13 is a graph of the E and H-plane patterns for the configuration described with respect to FIG. 12;

FIG. 14 is a graph of the input return loss for an annularly-shaped direct-radiating slot as shown in FIGS. 9*a*, 9*b*, and 11*b;*

Figure 15B:
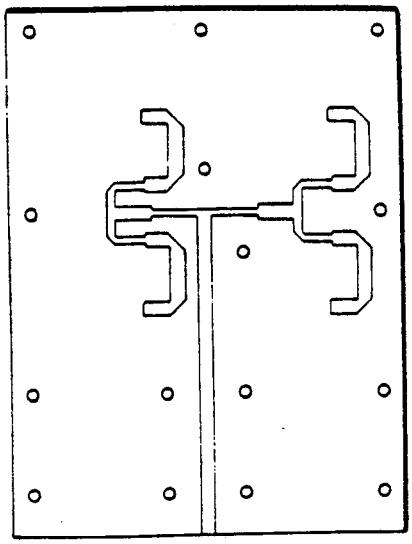
Figure 15A:
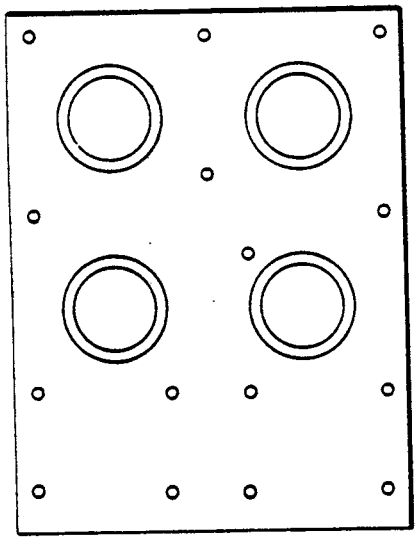
Figure 16:
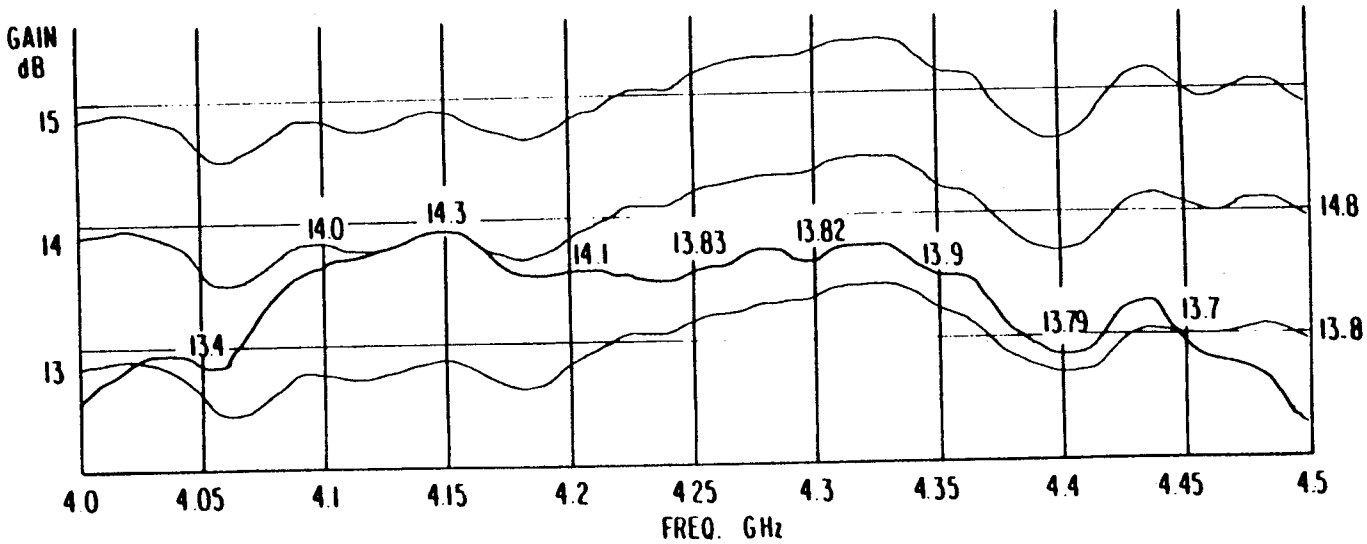

FIGS. 15*a* and 15*b* respectively show a four-element array and a power divider network for that array, in accordance with the second embodiment of the invention;

FIG. 16 is a graph of gain vs. frequency for the array shown in FIGS. 15*a* and 15*b;*

Figure 17:
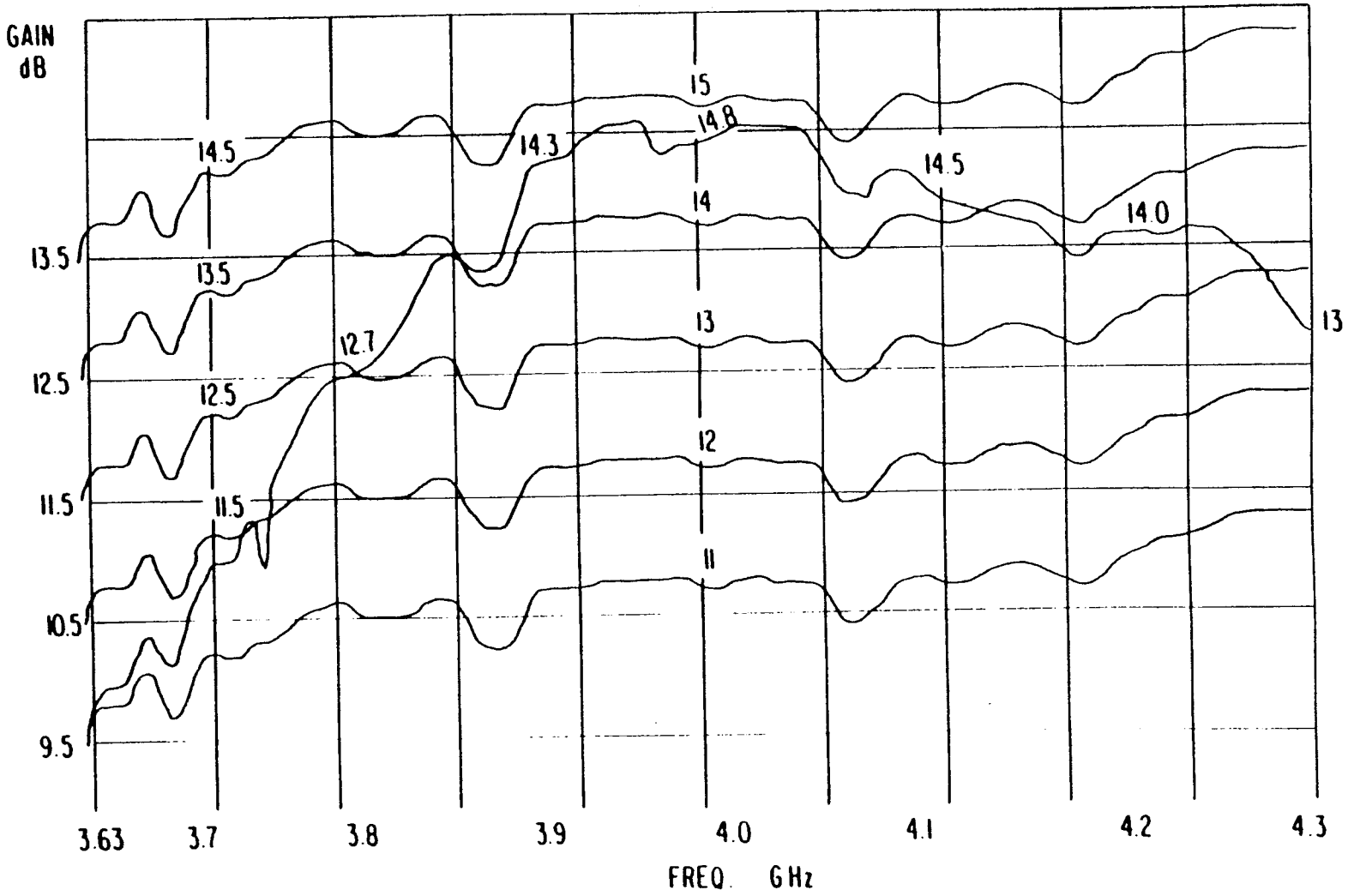

FIG. 17 is a graph of the gain of a four-element array employing square patches in a linearly polarized slot radiator as shown in FIG. 11*a:*

Figure 18A:
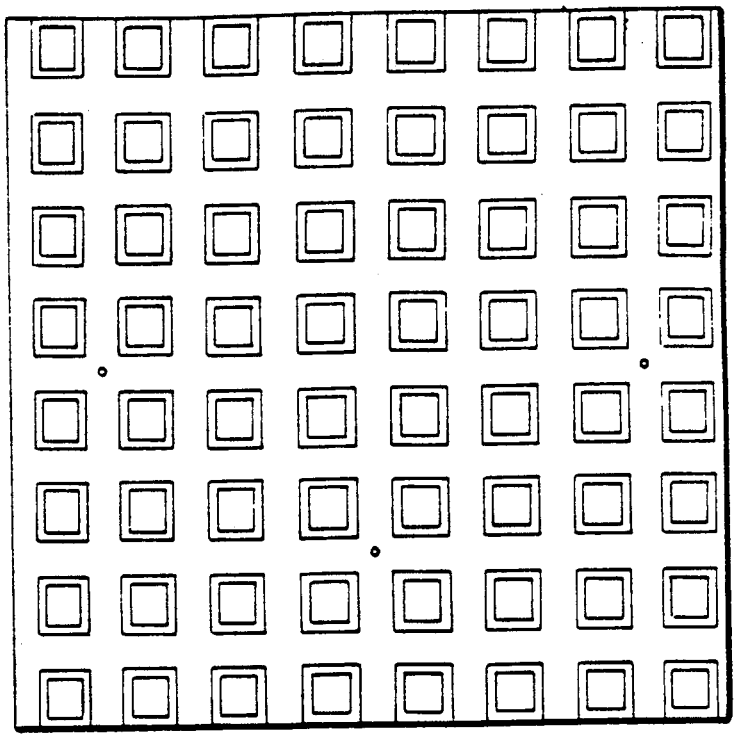
Figure 18B:
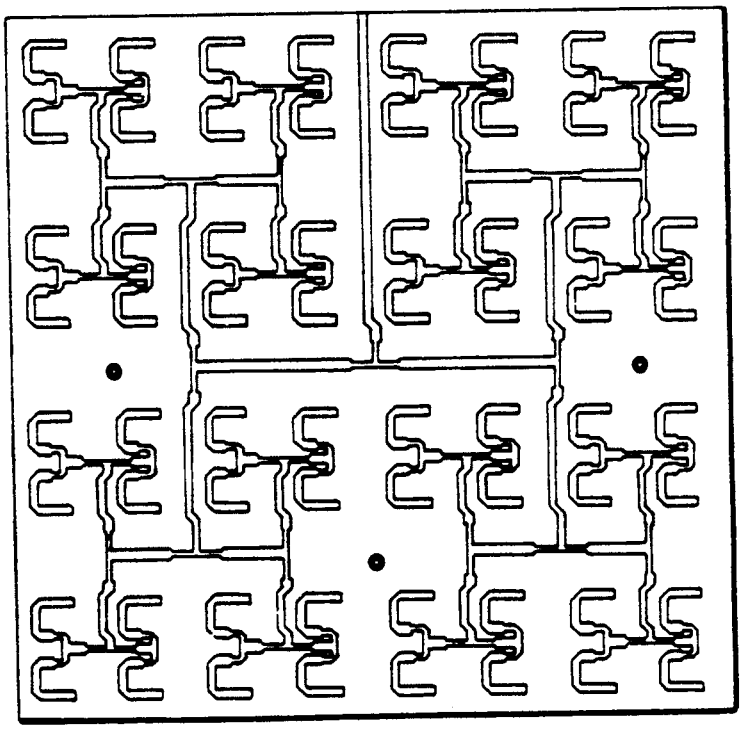

FIGS. 18*a* and 18*b* respectively show a 64-element array and a power divider network for that array, in accordance with the second embodiment of the invention:

FIG. 19 is a graph of the gain for the array shown in FIGS. 18*a* and 18*b;*

Figure 20:
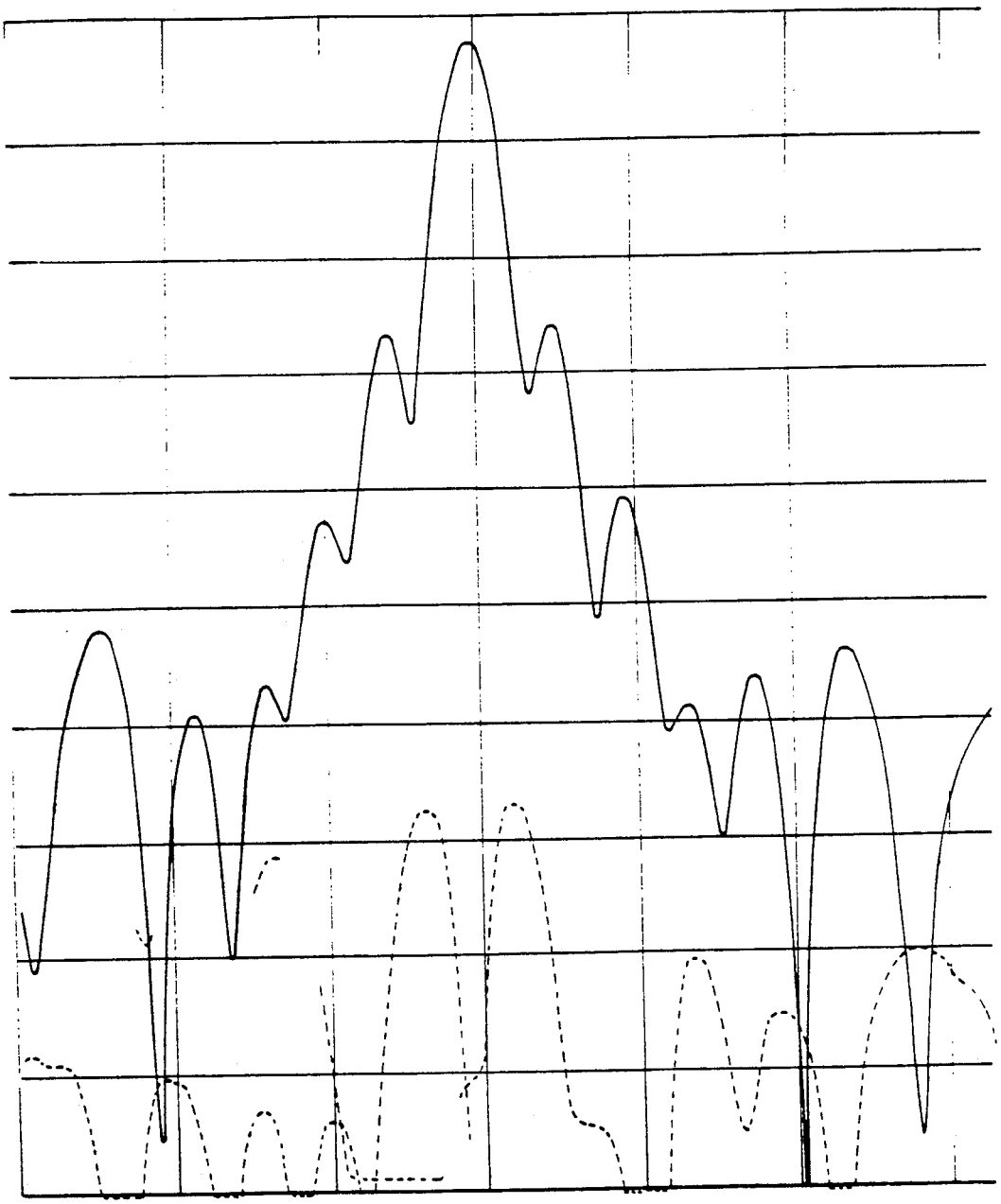
Figure 22A:
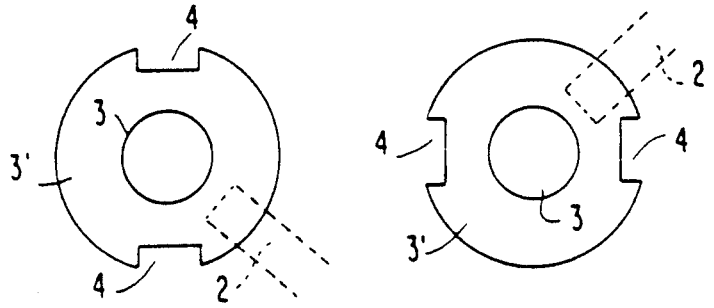
Figure 22B:
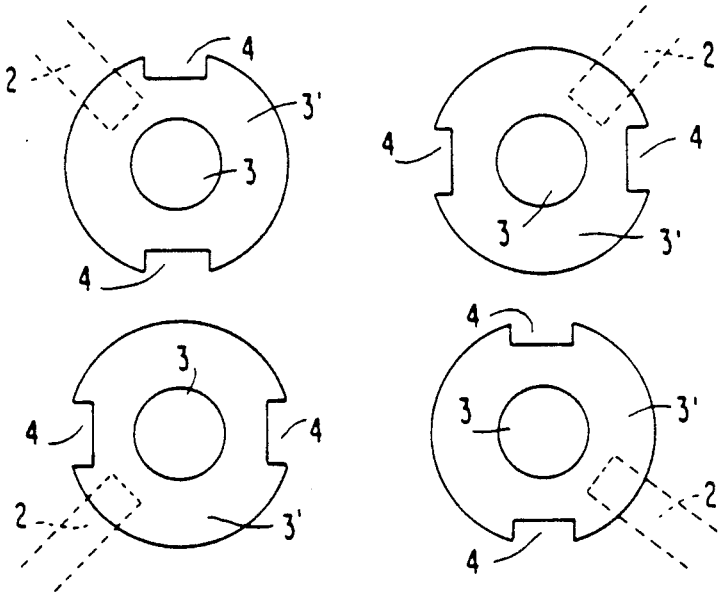
Figure 23:
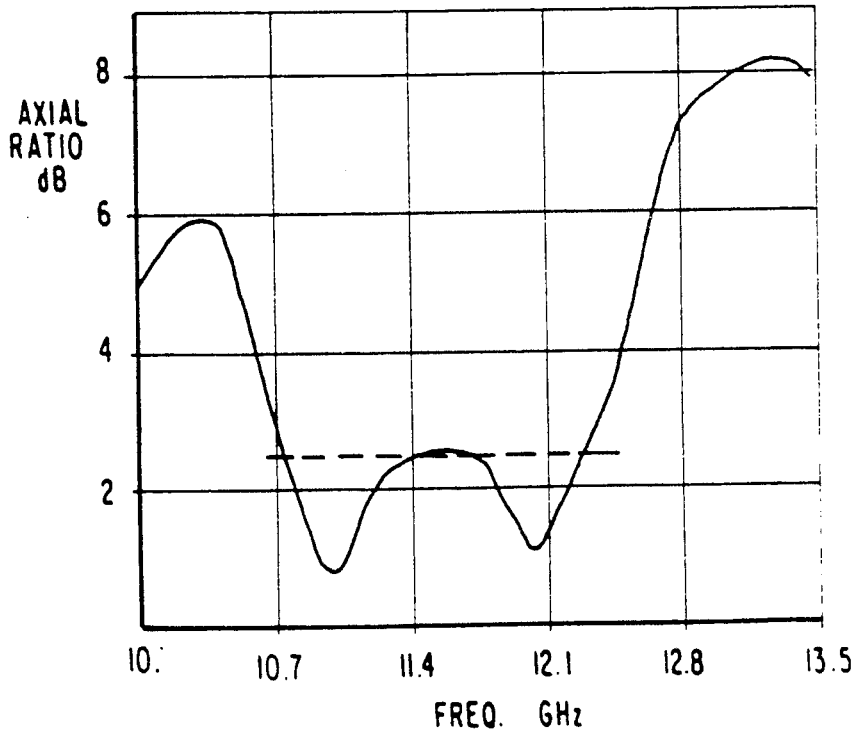

FIG. 20 is a graph of the H-plane copolarization and cross-polarization radiation patterns of the array shown in FIG. 18;

FIGS. 21*a*–21*f* show a variety of possible perturbation tab or indentation configurations for elements shown in FIGS. 9*a* and 9*b* which are circularly polarized by capacitive coupling at a single point to the feedline:

FIGS. 22*a*–22*b* show different techniques for capacitively coupling the feedline to the circularly polarized elements shown in FIGS. 21*a*–21*f*, where quadrature phasing is applied between each adjacent element; and FIG. 23 is a graph of axial ratio versus frequency for a four-element array utilizing the element/feeding design shown in FIGS. 21*a*–21*f*.

DETAILED DESCRIPTION OF THE PREFERRED EMBODIMENTS

Referring to FIGS. 1*a*–1*d*, a feedline 2 is truncated, tapered, or changed in shape in order to match the feedline to the printed-circuit antenna, and is capacitively coupled to a feeding patch 3 (FIG. 1*a*) or radiating slot 3' (FIG. 1*b*), the feedline being disposed between the feeding patch or radiating slot and a ground plane 1. In FIG. 1*b*, the radiating slot is formed by an absence of metal in an additional ground plane 1, the feedline 2 being disposed between the two ground planes 1, 1 . The feedline is implemented with microstrip, stripline, finline, or coplanar waveguide technologies.

Figure 1C:
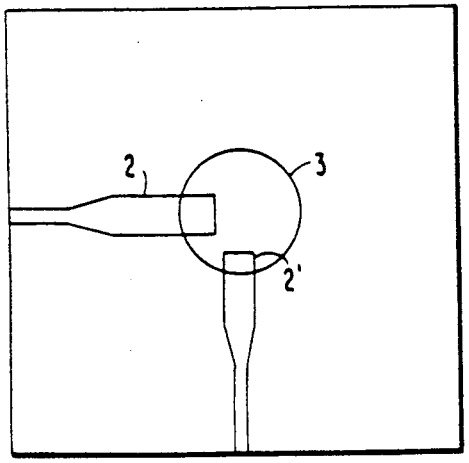
FIG. 1*c* shows a top view of the patch antenna element of FIG. 1*a;*
Figure 1D:
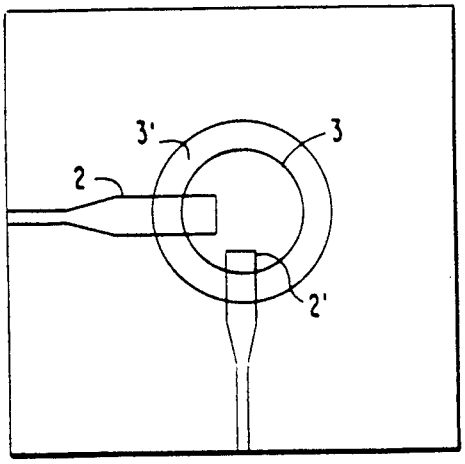

In FIG. 1*c*, an additional feedline 2' is shown, in phase quadrature with the feedline 2, as a possible way of achieving circular polarization from a single radiating patch element. FIG. 1*d* shows a similar structure when a radiating slot 3' is employed.

The feedline 2 and the feeding patch 3 do not come into contact with each other. They are separated by a dielectric material, or by air. In accordance with a first embodiment of the invention, the feeding patch 3 in turn is electromagnetically coupled to a radiating patch 4, the feeding patch 3 and the radiating patch 4 being separated by a distance S. Again, a dielectric material or air may separate the feeding patch and the radiating patch. The feedline 2 must be spaced an appropriate fraction of a wavelength of electromagnetic radiation from the feeding patch 3. Similarly, the distance S between the feeding patch and the radiating patch must be determined in accordance with the wavelength λ. (In accordance with the second embodiment of the invention, which will be described below with reference to FIGS. 9*a*–9*b*, the radiating patch 4 is optional for operation of the antenna element when the second ground plane 1 (FIG. 1*b*) is employed and surrounds the feeding patch 3 on the same dielectric board, as noted above; in that case, the radiating slot 3' suffices for electromagnetic coupling.)

While the feeding elements and radiating elements in the Figures are circular, they may have any arbitrary but predefined shape.

FIG. 2 shows the return loss of an optimized linearly polarized, capacitively fed, electromagnetically coupled patch antenna of the type shown in FIG. 1*a*. It should be noted that a return loss of more than 20 dB is present on either side of a center frequency of 4.1 GHz.

FIG. 3*a* shows the feedline capacitively coupled to a feeding patch having diametrically opposed notches 4 cut out, the notches being at a 45 degree angle relative to the capacitive feedline coupling. Because the feedline may be tapered, i.e. it becomes wider as it approaches the feeding patch to minimize resistance, sufficient space for only one feedpoint per feeding patch may be available. Consequently, in order to achieve circular polarization, perturbation segments are necessary. These perturbation segments may be either the notches 4 shown in FIG. 3*a* or the tabs 5 shown in FIG. 3*b*, the tabs being positioned in the same manner as the notches relative to the feedline.

Two diametrically opposed perturbation segments are provided for each patch. Other shapes and locations of perturbation segments are possible. For the case where two feedpoints are possible, i.e. where sufficient space exists, perturbation segments may not be required. As noted above, such a configuration shown in FIGS. 1*c* and 1*d*, in which feedlines 2 and 2' are placed orthogonally with respect to each other with 90 degree phase shift in order to achieve circular polarization.

FIG. 4 shows the return loss of an optimized circularly polarized, capacitively fed, electromagnetically coupled patch antenna of the type shown in FIG. 3*b*. It should be noted that a return loss of more than 20 dB is present on either side of a center frequency of 4.1 GHz.

In FIG. 5, a plurality of elements making up an array are shown. The perturbation segments on each element are oriented differently with respect to the segment positionings on the other elements, though each feedline is positioned at the above-mentioned 45 degree orientation with respect to each diametrically-opposed pair of segments on each feeding patch. The line 7 feeds to a ring hybrid 8 which in turn feeds two branch-line couplers 9 on a feed network board. This results in the feedlines 2 being at progressive 90 degree phase shifts from each other. Other feed networks producing the proper power division and phase progression can be used.

The use of perturbation segments enables the use of only a single feedline for each element in the array shown in FIG. 5. As a result, the overall configuration is simpler, though where the patches employed are sufficiently large, multiple feedlines, as shown in FIGS. 1*c* and 1*d*, may be employed.

The feeding patches are disposed such that they are in alignment with radiating patches (not numbered). That is, for any given pair comprising a feeding patch and a radiating patch, the tabs (or notches) are in register. The pairs are arranged such that the polarization of any two adjacent pairs is orthogonal. In other words, the perturbation segments of a feeding patch will be orthogonal with respect to the feeding patches adjacent thereto.

Individual feedlines couple to the feeding patches. As a result, the overall array in accordance with the first embodiment may comprise three boards which do not contact each other: a feed network board; a feeding patch board; and a radiating patch board.

In addition, while FIG. 5 shows a four-element array, any number of elements may be used to make an array, in order to obtain higher gain arrays. Of course, the perturbation segments must be positioned appropriately with respect to each other; for the four-element configuration, these segments are positioned orthogonally.

Another parameter which may be varied is the size of the tabs or notches used as perturbation segments in relation to the length and width of the feeding and radiating patches. The size of the segments affects the extent and quality of circular polarization achieved.

FIG. 6 shows the return loss for a four-element microstrip antenna array fabricated according to the invention, and similar to the antenna array shown in FIG. 5. As can be seen from the Figure, the overall return loss is close to 20 dB over 750 MHz, or about 18% bandwidth.

FIG. 7 shows the axial ratio, which is the ratio of the major axis to the minor axis of polarization, for an optimal perturbation segment size. The axial ratio is less than 1 dB over 475 MHz, or about 12% bandwidth. The size of the perturbation segments may be varied to obtain different axial ratios.

Further, a plurality of arrays having configurations similar to that shown in FIG. 5 may be combined to form an array as shown in FIG. 8. (In this case, the FIG. 5 arrays may be thought of as subarrays.) Each subarray may have a different number of elements. If circular polarization is desired, of course, the perturbation segments on the elements in each subarray must be positioned appropriately within the subarray, as described above with respect to FIG. 5. In particular, the perturbation segments should be positioned at regular angular intervals within each subarray, such that the sum of the angular increments (phase shifts) between elements in each closed-loop subarray is 360 degrees. In other words, the angular increment between the respective adjacent elements is 360/N, where N is the number of elements in a given subarray.

A second embodiment of the invention now will be described with respect to FIGS. 9–23. The description of the first embodiment set forth results measured for single and electromagnetically coupled patch radiators when fed by a microstrip transmission line. Excitation of these elements has been achieved via capacitive coupling from the feedline to the radiating element.

If stripline technology is employed for the feedline then excitation of the feed element also may be accomplished by capacitive coupling as shown in FIG. 1*b*. Such a feeding arrangement also would be amenable to use in conjunction with other feeding technologies, such as microstrip and slotline. Other such technologies also may be employed. When stripline is employed, the driven radiating element would be a slot 3' formed by the absence of metal in the upper ground plane 1'. Radiation then may be enhanced by including a coupled patch element 4 above the slot 3'. also as shown in FIG. 1*b*.

However, by proper feeding and selection of slot parameters, efficient broadband radiation may be achieved without including the parasitically coupled radiating patch 4 shown in FIG. 1*b*. Such an alternative configuration, which corresponds to the second preferred embodiment of the invention which will be described below, is shown in FIGS. 9*a* and 9*b*. In both cases shown in these Figures, the radiating patch layer has been removed, the radiating slot 3' performing alone the function of the radiating patch 4. For relatively small electrical thicknesses t ($t \leqq \lambda/2$) between the ground plane and the feeding patch 3 (as normally is the case), it is possible to include the patch on the same side as the ground plane 1, without eroding performance, as shown particularly in FIG. 9*b*. Additionally, such a configuration is advantageous in that the upper board on which the ground plane 1' and patch 3 are included may act as a protective cover for the radiating elements, rather than as a base for an additional element.

The feeding of the slot may be accomplished in a number of ways. By way of example, FIG. 10*a* shows a circular feed arrangement; FIG. 10*b* shows a paddle feed arrangement: and FIG. 10*c* shows a truncated line feed arrangement. With respect to FIG. 10*c*, it should be noted that the feedline 2 is not tapered.

Of these three techniques, the present inventors have found the paddle and truncated line feeds to be the most satisfactory under most operating conditions, and in all subsequent designs, the truncated line feed has been used exclusively with a variety of slot designs. Those slot designs will be described below.

FIGS. 11*a*–11*f* show examples of different shapes which the slot or slot/patch configuration of FIG. 1*b* may take, in order to achieve efficient radiation of linearly polarized signals. In this case, the slot 3' preferably is formed by the vacant area between any combination of circular, rectangular, or square shapes. The shape of the radiating patch, where used, preferably corresponds to the shape of the contour of the slot.

Measurements conducted on the type of patch coupled slot radiator shown in FIG. 1*b* indicate that efficient broadband radiation performance also is possible with that configuration. FIG. 12 shows the measured input match for a circular slot element feeding a circular radiating patch, which configuration is exemplified in FIG. 11*b*. A very wide match of over 14% bandwidth has been achieved.

Also the radiation pattern for such an element reveals the radiation and linear polarization purity of the element. FIG. 13 shows the typical E and H plane patterns for such an element. The frequency of interest is 3.93 GHz. The cross-polarization performance (top line in both the E-plane and H-plane graphs) over the main beam area is quite low—an attestation to good polarization purity.

Efficient radiators also may be achieved by implementing either of the configurations shown in FIGS. 9*a* and 9*b*. In these configurations, as noted above, the coupled radiating patch 4 has been eliminated. FIG. 14 shows the input return loss of an annular slot fed by a truncated stripline feed; this configuration is shown in FIG. 10*c*, and in FIG. 11 generally. As can be seen from the graph, there is a range of 800 MHz with better than 10 dB return loss. This corresponds to approximately 20% of usable bandwidth.

FIGS. 15*a* and 15*b* show an array of four annular slot elements of the type shown in FIG. 9*a* and 9*b*. The radiating slots are shown in FIG. 15*a*: the power dividing network is shown in FIG. 15*b*. Elements in this type of array also exhibit efficient radiation properties. FIG. 16 is a graph of the measured gain of that four-element array, and shows the efficient performance of such a four-element array over a wide bandwidth. Also, from FIG. 16 it is apparent that an element gain of greater than 8 dB may be attributed to the radiating element. Larger arrays of such elements also exhibit high efficiency.

Figure 11C:
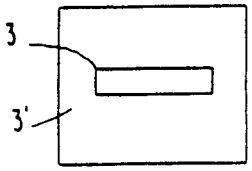
Figure 11D:
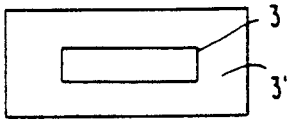
Figure 11E:
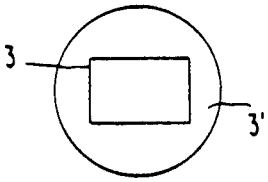
Figure 11F:
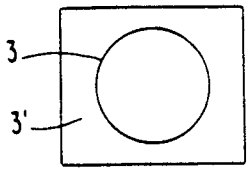

FIGS. 11*a*, 11*c*, and 11*d* depict a square-shaped linearly polarized slot radiator that has good broadband performance and is a highly efficient radiator. FIG. 17 shows the measured gain for an array of four such elements, and demonstrate a gain of over 8.5 dB for individual elements in that array. Again, larger arrays of such elements have proved to be very efficient, and have displayed excellent polarization characteristics.

FIG. 18*a* shows a 64-element slot array design, and FIG. 18*b* shows the power divider network for that array design. FIGS. 19 and 20 show the corresponding gain and radiation performance that array. FIG. 19 shows that the array of FIGS. 18*a*–18*b* has an overall efficiency approaching 65%. In FIG. 20, the frequency of interest is 4 GHz. In this Figure, it can be seen from the radiation pattern of the array that the feeding element generates low cross polarization.

By employing an appropriate design for the slot radiator, configurations such as those depicted in FIGS. 9*a* and 9*b* can be used to form high efficiency, circularly polarized elements and arrays having high polarization purity. Circular polarization is generated for each element, in a manner similar to that used in the first embodiment described above, by appropriately locating perturbation segments on either the inner or the outer contour of the slot 3'. Some possible perturbation designs are depicted in FIGS. 21*a*–21*f*; other designs also are possible. In each of the designs shown, the feedline 2 excites the slot 3' at an angle of 45° to the perturbation segment. The configurations shown in FIGS. 21*a* and 21*b* have been determined by the present applicants to be particularly suitable; the performance for the configuration shown in FIG. 21*b* will be described below.

FIGS. 22*a* and 22*b* depict possible array configurations of such elements, the arrays having high gain and high polarization purity. In FIG. 22*a*, an array of two elements is shown capacitively coupled to feeding lines and fed 90° out of phase. In FIG. 22*b*, an array of four elements (two pairs of elements) are shown capacitively coupled to feeding lines and fed progressively 90° out of phase. This approach is analogous to that described above with respect to FIG. 5. Truncated line feeds, such as that shown in FIG. 10*c*, are employed. The techniques shown in FIGS. 22*a* and 22*b* may be employed to achieve an improved axial ratio over a wide band.

In general, the perturbation segments should be positioned at regular angular intervals within each subarray, such that the sum of the angular increments (phase shifts) between elements in each closed-loop subarray is 360 degrees. In other words, the angular increment between the respective adjacent elements is 360/N, where N is the number of elements in a given subarray.

Also, it is possible to feed four inherently linear elements without perturbation segments in a like manner using sequential 90° phase shifts between elements and still achieve circular polarization. However, the performance will be slightly inferior to that achieved when perturbation segments are employed.

A four-element array has been tested wherein the elements have the design shown in FIG. 21*b*, and are fed as shown in FIG. 22*b*. FIG. 23 shows the measured axial ratio of such an array, and in particular shows a low axial ratio over a significantly wide bandwidth (>10%). The array proved to have high efficiency.

The overall technique described above enables inexpensive, simple manufacture of printed-circuit antenna arrays whose elements are linearly polarized or circularly polarized, which have high polarization purity, and which perform well over a wide bandwidth. All these features make a printed-circuit antenna manufactured according to the present invention attractive for use in DBS and other applications, as well as in those applications employing different frequency bands, such as maritime, TVRO, etc. The construction of the array also is amenable to the integration of MIC and MMIC circuits for low noise reception, power amplification, and electronic beam steering.

Although the invention has been described in terms of employing one or two layers of patches or slots for wideband applications, a multiplicity of layers can be used. When a multiplicity of layers are used, all the layers should be electromagnetically coupled, and can be designed with different sets of dimensions to produce either wideband operation or multiple frequency operation.

Although the invention has been described and shown in terms of preferred embodiments thereof and possible applications therefor, it will be understood by those skilled in the art that changes in form and detail may be made therein without departing from the spirit and scope of the invention as defined in the appended claims.

What is claimed is:

1. A method of forming microstrip antennas, comprising the following steps:

(i) providing a feed network board having a plurality of feedlines which are impedance matched with other microstrip antenna elements;

(ii) providing a feeding element board having a plurality of feeding elements which are impedance matched with said feedlines;

(iii) providing a radiating element board having a plurality of radiating elements which are impedance matched with said feeding elements and said feedlines;

(iv) contactlessly coupling said feed network board to said feeding element board; and (v) contactlessly coupling said feeding element board to said radiating element board.

2. A method according to claim 1, wherein said feeding elements are feeding patches, and said radiating elements include radiating patches, said feedline being disposed on a first dielectric board, said feeding patches being disposed on a second dielectric board, and said radiating patches being disposed on a third dielectric board, said steps (iv) and (v) comprising the steps of contactlessly coupling said first and second dielectric boards and contactlessly coupling said second and third dielectric boards.

3. A method according to claim 1, wherein said steps (iv)-(v) are performed so as to achieve linear polarization.

4. A method according to claim 1, wherein said steps (iv)-(v) are performed so as to achieve circular polarization, by coupling each of said feeding elements to two feedlines.

5. A method according to claim 1, wherein said steps (iv)-(v) are performed so as to achieve circular polarization, by coupling each of said feeding elements to one feedline.

6. A method according to claim 5 wherein each of said feeding elements includes a plurality of first perturbation segments and each of said radiating elements includes a plurality of second perturbation segments, said step (v) being performed such said first and second perturbation segments on each of said feeding elements and said radiating elements are in register.

7. A method according to claim 1, further comprising the following steps:

(vi) forming a ground plane by placing ground plane material on one side of at least one of said dielectric boards; and (vii) forming a plurality of radiating slots by removing some of said ground plane material.

wherein said radiating elements include said radiating slots, said radiating slots and said feeding elements are disposed on the same dielectric board, and said feeding elements are disposed on an opposite side of said dielectric board from said radiating slots.

8. A method according to claim 1, wherein said radiating elements include radiating slots said radiating slots and said feeding elements are disposed on the same dielectric board, and said feeding elements are disposed on the same side of said dielectric board as said radiating slots.

9. A method according to claim 1, wherein said radiating elements include radiating slots and radiating patches, said radiating slots and said feeding elements being disposed on the same dielectric board and said radiating patches being disposed on a third dielectric board.

10. A microstrip antenna, comprising:

a plurality of feedlines;

a plurality of feeding elements, each coupled in a contactless manner to at least a respective one of said plurality of feedlines, said feeding elements being impedance matched with said feedlines; and a plurality of radiating elements, each coupled in a contactless manner to a respective one of said plurality of feeding elements, wherein said feedlines are capacitively coupled to said feeding elements and said feeding elements are capacitively coupled to said radiating elements.

11. A printed-circuit antenna array according to claim 10, further comprising at least two dielectric boards on which said feedlines, said feeding elements, and said radiating elements together are disposed.

12. A printed-circuit antenna array according to claim 11, wherein said radiating elements include radiating slots, said feeding elements and said radiating slots being disposed on the same one of said at least two dielectric boards.

13. A printed-circuit antenna according to claim 12, further comprising ground plane means formed on the same one of said at least two dielectric boards as said feeding elements, and wherein said radiating elements include radiating slots formed by an absence of material in said ground plane means.

14. A printed-circuit antenna according to claim 13, wherein said feeding elements comprise feeding patches, and wherein said radiating slots and said feeding patches have correspondingly predefined shapes.

15. A printed-circuit antenna according to claim 14, wherein said feeding elements and said radiating slots are circular.

16. A printed-circuit antenna according to claim 14, wherein said feedlines have a paddle shape.

17. A printed-circuit antenna according to claim 11, wherein said feedlines and said feedling elements are disposed on different ones of said at least two dielectric boards.

18. A printed-circuit antenna according to claim 17, each of said feeding elements being coupled to at least one feedline for achieving circular polarization.

19. A printed-circuit antenna according to claim 11, each of said feedlines being coupled to a corresponding one of said feeding elements in accordance with a parameter substantially related to a wavelength of electromagnetic radiation, each of said feeding elements being coupled to a corresponding one of said radiating elements in accordance with a parameter substantially related to a wavelength of electromagnetic radiation.

20. A printed-circuit antenna according to claim 10, each of said plurality of feedlines, said plurality of feeding elements, and said plurality of radiating elements being separated into at least two groups, each group of feedlines, feeding elements, and radiating elements forming a subarray, whereby at least two subarrays are formed, the subarrays being connected to a common feedline.

21. A printed-circuit antenna array according to claim 20, wherein each of said subarrays has at least four of said feedlines, four of said feeding elements, and four of said radiating elements.

22. A printed-circuit antenna array according to claim 21, wherein said subarrays are combined such that said array has 64 of each of said feedlines, said feeding elements, and said radiating elements. least two subarrays are formed, the subarrays being connected to a common feedline.

23. A printed-circuit antenna array according to claim 20, wherein at least some of said radiating elements are radiating patches, said array further comprising a third dielectric board, said radiating patches being disposed on said third dielectric board.

24. A printed-circuit antenna array according to claim 23, wherein said plurality of feeding elements includes a plurality of first perturbation segments and said plurality of radiating elements includes a plurality of second perturbation segments, said first and second perturbation segments being aligned so as to achieve circular polarization.

25. A printed-circuit antenna array according to claim 24, wherein the number of elements in a first one of said at least two groups is $N_1$ and the number of elements in a second one of said at least two groups is $N_2$, where $N_1$ and $N_2$ are integers greater than 1, and wherein a first angular displacement of the perturbation segments of one radiating element relative to the perturbation segments on adjacent radiating elements within said first one of said at least two groups is equal to 360 degrees divided by $N_1$, and a second angular displacement of the perturbation segments of one radiating element relative to the perturbation segments on adjacent radiating elements within said second one of said at least two groups is equal to 360 degrees divided by $N_2$.

26. A printed-circuit antenna array according to claim 24, wherein the number of said first and second perturbation segments is two, said first perturbation segments being diametrically opposed with respect to each other on each of said feeding elements, and each of said feedlines is coupled to a corresponding one of said feeding elements at an angle of 45 degrees with respect to one of said first perturbation segments.

27. A printed-circuit antenna array according to claim 24, wherein said first and second perturbation segments comprise tabs extending from said feeding elements and said radiating elements respectively.

28. A printed-circuit antenna array according to claim 24, wherein said first and second perturbation segments comprise notches cut out from said feeding elements and said radiating elements respectively.

29. A printed-circuit antenna array according to claim 10, wherein said feeding elements and radiating elements have an arbitrarily but correspondingly predefined shape.

* * * * *

UNITED STATES PATENT AND TRADEMARK OFFICE

CERTIFICATE OF CORRECTION

PATENT NO. : 5,005,019

DATED : April 2, 1991

INVENTOR(S) : Amir I. ZAGHLOUL ET AL.

It is certified that error appears in the above-identified patent and that said Letters Patent is hereby corrected as shown below:

Column 4, line 41, delete "1" and insert --1'--;

line 43, delete "1." and insert --1'.--;

line 60, after "wavelength" insert --λ--;

line 68, delete "1," and insert --1'--.

Column 7, line 6, delete "1" and insert --1'--.

Column 11, lines 29 and 30, delete "least two subarrays are formed, the subarrays being connected to a common feedline."

Signed and Sealed this

Ninth Day of March, 1993

*Attest:*

STEPHEN G. KUNIN

*Attesting Officer*

*Acting Commissioner of Patents and Trademarks*